US009068793B1

(12) United States Patent
Barrett

(10) Patent No.: US 9,068,793 B1
(45) Date of Patent: Jun. 30, 2015

(54) RECEIVER FOR A FIREARM

(76) Inventor: Christopher Gene Barrett, Murfreesboro, TN (US)

( * ) Notice: Subject to any disclaimer, the term of this patent is extended or adjusted under 35 U.S.C. 154(b) by 419 days.

(21) Appl. No.: 13/194,497

(22) Filed: Jul. 29, 2011

(51) Int. Cl.
*F41C 23/00* (2006.01)
*F41C 23/22* (2006.01)
*F41C 23/16* (2006.01)

(52) U.S. Cl.
CPC ..... *F41C 23/16* (2013.01); *F41C 23/22* (2013.01)

(58) Field of Classification Search
USPC ..... 42/71.01; 89/191.01, 1.4
See application file for complete search history.

(56) References Cited

U.S. PATENT DOCUMENTS

| | | | | |
|---|---|---|---|---|
| 8,117,954 | B1 * | 2/2012 | Davis | 89/1.4 |
| 8,266,998 | B1 * | 9/2012 | Davis | 89/1.4 |
| 2011/0005384 | A1 * | 1/2011 | Lewis et al. | 89/191.01 |
| 2012/0152104 | A1 * | 6/2012 | Audibert et al. | 89/191.01 |

* cited by examiner

*Primary Examiner* — Michelle R Clement
(74) *Attorney, Agent, or Firm* — Patterson Intellectual Property Law, P.C.; Ryan D. Levy

(57) ABSTRACT

An upper receiver of a firearm including a body with an interior, an opening for a barrel extension, and one or more engagements for communicating with a lower receiver of a rifle; a high wear area located on the interior of the receiver; a relief cut at the high wear area; and a wear plate fit within the relief cut of the high wear area located on the interior of the aluminum body, the wear plate having an expose surface.

5 Claims, 8 Drawing Sheets

RECEIVER FOR A FIREARM

BACKGROUND OF THE INVENTION

1. Technical Field

The present invention relates to a receiver for a firearm, the receiver being suitable for use in an AR15/M16 style rifle. In optional embodiments, the receiver may be used with various configurations and adaptations of AR15/M16 style rifles, including but not limited to direct impingement and piston-operated configurations. In yet further optional embodiments, the invention may include a firearm configured with the receiver disclosed herein or further may include a method of extending the operating life of a firearm.

2. Background of the Art

In the field of firearms, there are a multitude of different designs and types of rifles. One popular model includes what is known as the AR-15 rifle. Generally speaking, the AR-15 rifle was an abbreviation for the Armalite Model 15 rifle, which is understood to refer to a semi-automatic firearm having a design based on the original design of Eugene Stoner. While AR-15 is still a federally registered trademark of Colt, the populous uses the term AR-15 to refer to the general style of rifle which is available from a wide number of manufacturers, produced both in the United States and overseas. Other designations for similarly styled rifles are used, including both M4 and M16, referring to United States military variants, which may optionally include selective fire options. Additionally, the design is considered one of a modular nature and can include pistol variants as well.

Most AR-15/M16 style rifles use a mechanism of operation which can be understood to be a direct gas impingement system. With such system, high pressure gas acts directly upon the bolt and the carrier containing the bolt, eliminating the need for a piston or separate gas cylinder. Upon firing an AR-15/M16 style rifle, gas generated from the detonation of the powder moves through a gas port located in the top area of a barrel. Gas flows through the gas port into the gas block where it is directed into a gas tube, running generally about parallel with the barrel. The gas tube protrudes into the upper receiver of the AR-15/M16 style rifle and extends into the bolt carrier key (also referred to as a "gas key") which directs gas into the bolt carrier. In turning down into the bolt carrier, the gas has space to expand within the carrier and forces the bolt carrier rearward toward the stock of the AR-15/M16 style rifle while forcing the bolt forward. This movement essentially unlocks the bolt from the forward position where the original detonation of the round took place. During the rearward movement of the carrier, a cam pin in the bolt necessitates that the bolt rotates and unlocks from the barrel extension of the barrel within the upper receiver. Thus, both the carrier and bolt move rearward together which extracts the empty cartridge prior to moving forward again, while a new round is chambered.

As previously mentioned, there exist further variants of AR-15/M16 style rifles that include piston operating systems. In such variants, a piston rod may be used that reciprocally moves between at least two positions. The piston can be coupled to the bolt carrier for movement of the bolt carrier from a first closed position to the open position, similarly to the movement obtained with a direct gas impingement operating system. In further optional embodiments, the piston is not attached to the bolt carrier but rather is simply in physical contact with the bolt carrier and thus can apply pressure to create movement. To function, gas generated from a detonated round flows through the gas port but instead of flowing down a gas tube as occurs with direct impingement operating systems, the gas forcefully acts on the face of the piston. This action drives the piston rearward and a rod or shaft in connection with the piston as well, which in turn applies abrupt force to the bolt carrier, having the rotatable bolt with cam pin. The bolt carrier moves rearward, the spent cartridge is ejected and the cycling commences similar to a direct impingement system, yet no gas directly acts upon the bolt and carrier.

Further considerations in the design of an operating system for an AR-15/M16 style rifle include considerations on the use of suppressors with the rifle, which may have an impact upon the amount of gas returning to the bolt and carrier in a direct impingement system or the speed of the piston and rod in a piston operating system. Such usage can accelerate wear on the firearm or alternative affect the performance.

In the AR-15/M16 style rifle, the upper receiver houses the bolt and carrier as well contains the opening for the extension of the barrel to within the interior of the receiver and a relief area that allows the cam pin to index out of the tract. Within the upper receiver of this style of rifle is also a track for the cam pin. In operating the firearm, the cam pin can create wear within the upper receiver, especially where the cam pin cams over into the tract relief area. Over time, this can result in wear into the receiver as most often the cam pin is of harden steel as it must withstand the force generated by detonating rounds.

In some instances, this cam pin-created wear can result in significant indentations and/or gouges in the upper receiver, possibly causing issues with the functionality of the rifle. While this issue can occur with direct impingement operating systems, the use of gas piston systems of various types can also cause this wear, resulting in deterioration of the upper receiver. Furthermore, as the use of suppressors has steadily become more common, the increased flow of gas may also exacerbate this issue, thus resulting in increased receiver wear. What is desired is a way of decreasing wear on the receiver of an AR-15/M16 style rifle.

SUMMARY OF THE INVENTION

An optional aspect of the present invention may include an upper receiver of a firearm which includes a receiver body, a cam pin track located on the interior of the body of the receiver; and a wear plate positioned in the interior of the body of the receiver with an exposed surface forming part of the cam pin track with the body of the receiver.

An additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the body of the receiver, the wear plate being formed of steel, including either hardened steel or stainless steel.

A further additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the body of the receiver, the wear plate being formed of a material chosen from metals, alloys, ceramics, polymers, and composites.

An additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track wherein the receiver body includes a relief cut for the wear plate with the wear plate sized and positioned within the relief cut.

A yet further additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate being permanently affixed to the receiver.

An additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate including one or more studs that extend into the body of the upper receiver, with the upper receiver including holes for the one or more studs.

An even further additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate including one or more studs that extend into the body of the upper receiver, with the upper receiver including holes for the one or more studs with the studs being swaged to permanently attach the wear plate to the upper receiver.

Another optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate being replaceable.

An additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate being formed of a different material than the material of the body of the receiver.

A further additional optional aspect of the present invention may include an upper receiver of a firearm which includes a receiver body, a cam pin track located on the interior of the body of the receiver, and a wear plate positioned in the interior of the body of the receiver with an exposed surface forming part of the cam pin track with the wear plate being formed of a harder material than the material of the body of the receiver.

Another additional optional aspect of the present invention may include an upper receiver of a firearm with a body with a barrel extension opening, ejection port, a rear receiver opening, a top, a bottom, an interior and an exterior; the body having a cam pin track located on the interior top surface of the body of the receiver; the cam pin track having a track surface, a track front located near the ejection port, a track rear located closer to the rear receiver opening, and a relief cut at the track front; and a wear plate on the interior of the body fit within the relief cut of the cam pin track; the wear plate having a rear surface and an exposed surface, the exposed surface forming a portion of the track surface of the cam pin track in the interior of the body of the receiver.

An additional optional aspect of the present invention may include an upper receiver of a firearm with a body with a barrel extension opening, ejection port, a rear receiver opening, a top, a bottom, an interior and an exterior; the body having a cam pin track located on the interior top surface of the body of the receiver; the cam pin track having a track surface, a track front located near the ejection port, a track rear located closer to the rear receiver opening, and a relief cut at the track front; and a wear plate on the interior of the body fit within the relief cut of the cam pin track; the wear plate having a rear surface and an exposed surface, the exposed surface forming a portion of the track surface of the cam pin track in the interior of the body of the receiver with the wear plate including one or more studs extending from the rear surface of the wear plate and the receiver including one or more holes to correspond to the one or more studs.

A further optional aspect of the present invention may include an upper receiver of a firearm with a body with a barrel extension opening, ejection port, a rear receiver opening, a top portion, a bottom portion, an interior and an exterior, the body formed of aluminum with an anodized coating; a cam pin track located on the interior of the body, formed in the receiver at the top portion of the receiver, the cam pin track having a track surface; a track front located near the ejection port, a track rear located closer to the rear receiver opening and a relief cut in the track surface; and a wear plate on the interior of the receiver fit within the relief cut of the track surface of the cam pin track, the wear plate having a rear surface and an exposed surface, the exposed surface forming a continuous surface with the track surface of the cam pin track, the wear plate formed of steel.

An additional optional aspect of the present invention may include an upper receiver for a firearm with a body with a barrel extension opening, ejection port, a rear receiver opening, a top portion, a bottom portion, an interior and an exterior, the body formed of 7075 aluminum with an anodized coating; a cam pin track located on the interior of the body, formed in the receiver at the top portion of the receiver, the cam pin track having a track surface; a track front located near the ejection port, a track rear located closer to the rear receiver opening and a relief cut in the track surface; and a wear plate on the interior of the receiver fit within the relief cut of the track surface of the cam pin track, the wear plate having a rear surface and an exposed surface, the exposed surface forming a continuous surface with the track surface of the cam pin track, the wear plate formed of steel.

An additional optional aspect of the present invention may include an upper receiver with an aluminum body with an interior, an opening for a barrel extension, and one or more engagements for communicating with a lower receiver of a rifle; a high wear area located on the interior of the aluminum body of the receiver; a relief cut at the high wear area; a wear plate fit within the relief cut of the high wear area located on the interior of the aluminum body, the wear plate having an exposed surface.

An additional optional aspect of the present invention may include an upper receiver with an aluminum body with an interior, an opening for a barrel extension, and one or more engagements for communicating with a lower receiver of a rifle; a cam pin track on the interior of the body of the receiver; a high wear area located on the interior of the aluminum body of the receiver at the cam pin track; a relief cut at the high wear area; a wear plate fit within the relief cut of the high wear area located on the interior of the aluminum body, the wear plate having an exposed surface.

In accordance with the purpose of the invention, as embodied and broadly described herein above and below, the invention includes an upper receiver for a firearm with a wear plate positioned in a high-wear area. The wear plate may be of steel or the like and is generally understood to have a greater durability than the portion of receiver for which the wear plate replaced. As used herein, "receiver" refers to the upper receiver of an AR15/M16 style rifle and when referring the lower receiver, the term "lower receiver" is used.

The wear plate may be permanently affixed to the receiver. As used herein, "permanently affixed" is understood to mean affixed for an extend duration and not intended to be removed and replaced. The wear plate may be affixed by a variety of different ways, one of which may include swaging. In affixing the wear plate in such an arrangement, generally one or more studs may extend from the wear plate which may be swaged as they extend into corresponding holes of the receiver. Other methods of permanently attaching the wear plate can include adhesive bonding or mechanical fastening. In even further embodiments, special welding techniques may be used to permanently affix the wear plate to the receiver. Obviously the choice of attachment methods may depend upon the specific material chosen for the wear plate. Also of consideration is the material of the receiver as different metals and/or alloys may react differently to one another in instances of bonding.

In describing the various optional aspects of the present invention, the term "AR15/M16 style rifle" is used. This term is not to be considered or taken as limiting, but rather is intended to cover other variants and related firearm platforms which may include the AR-10 and similar larger-caliber variants as well as the various configurations of the M4. The AR15/M16 style rifle and its variants, are not limited to but include the M16A2, M16A3, M16A4, the CAR-15 and its variants, the M4 and its variants, as well as the AR15 and its variants all of which are understood to be generally included with use of the term "AR15/M16 style rifle." Furthermore, the invention may be used for a wide range of calibers for this rifle platform and those calibers should be considered in addition to the standard .223 Remington/5.56×45 mm round with possible calibers even including 50 Cal. BMG. as well as other common military calibers.

As used herein the term "engage" means to interact with, interlock with, associate with or communicate with.

Further as used herein, the term "upper receiver" is used to be the portion of a rifle with which the barrel attaches. The upper receiver generally includes an ejection port as well as engagements for communicating with the lower receiver.

The term "providing", and forms thereof, are used in a broad sense, and are referred to, but are not limited to, making available for use, enabling usage, giving, supplying, obtaining, getting hold of, acquiring, making ready for use, and/or placing into position ready for use.

Additionally, the term "firearm" is used to indicate a weapon from which bullets are discharged by way of gunpowder. "Rifle" is used to indicate a firearm that may be fired from the shoulder and includes rifling within the bore. "AR15/M16 style rifle" as used herein is defined above but also includes the relatively few variants which may include the same general components but in a pistol configuration. In other words, the invention may be applicable to a variety of pistol configurations and the use of the term "AR15/M16 style rifle" includes those pistol configurations as well.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitute a part of this specification. The drawings illustrate optional embodiments of the invention and together with the description serve to explain some principles of the invention.

BRIEF DESCRIPTION OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION

Figure 1:
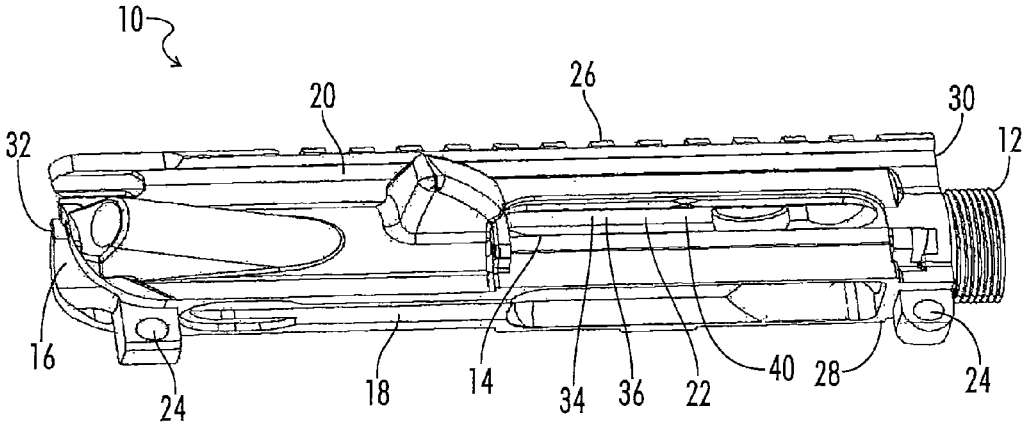
FIG. 1 is a bottom-side view of a prior art upper receiver for an AR15/M16 style rifle.
Figure 2:
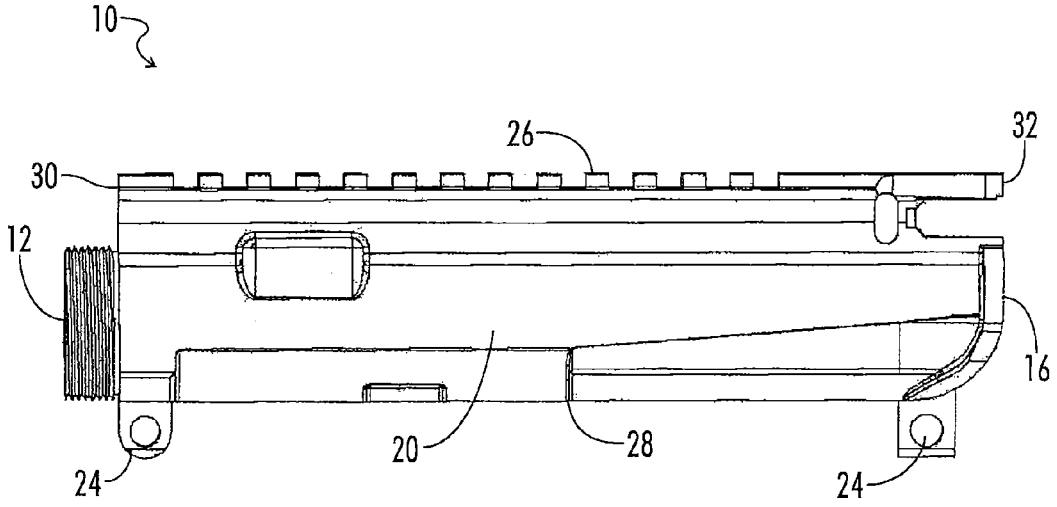
FIG. 2 is a side view of a prior art upper receiver for an AR15/M16 style rifle.
Figure 3:
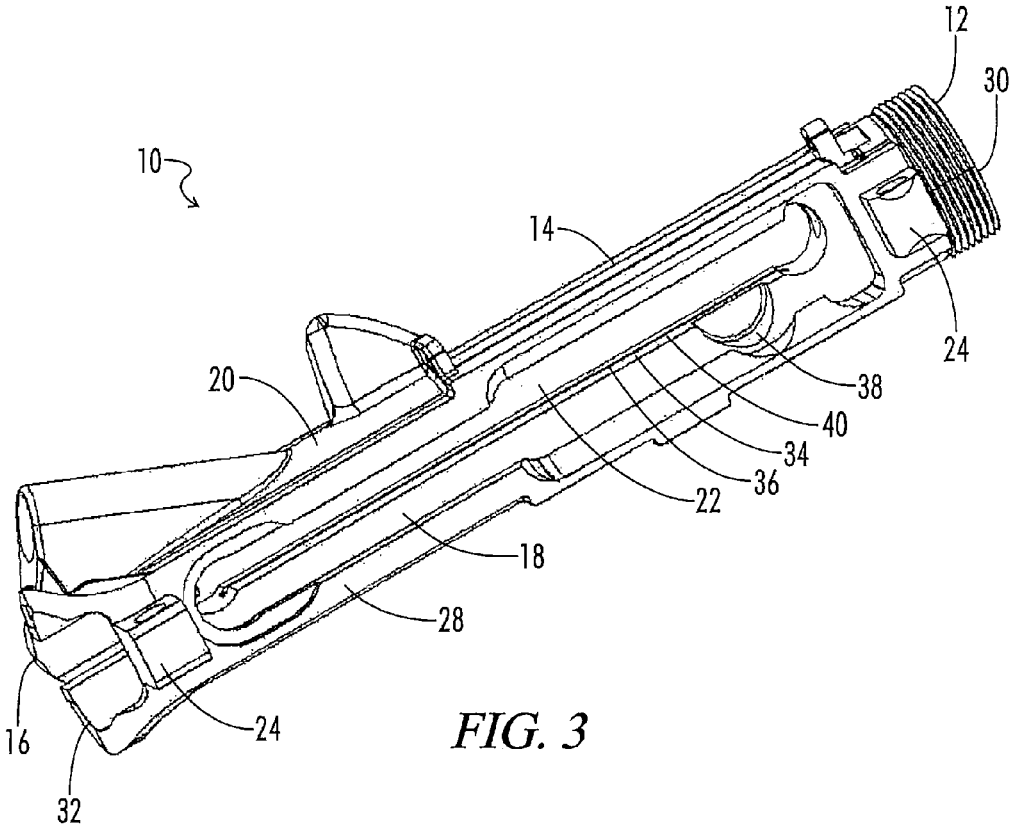
FIG. 3 is an angled-bottom view of a prior art upper receiver for an AR15/M16 style rifle.

As shown in FIGS. 1-3 there are multiple illustrations of a prior art upper receiver for an AR15/M16 style rifle. Generally, such upper receiver of the prior art has been indicated by the numeral 10. Prior art receiver 10 additionally includes barrel extension opening 12, ejection port 14 and rear receiver opening 16. Additionally, prior art receiver 10 also includes interior 18, exterior 20, cam pin track 22, and lower receiver connections 24.

The receiver 10 also has top 26, bottom 28, front 30 and rear 32. Cam pin track 22 is integrated into the body of receiver 10 and is generally understood to be situated at the top interior surface of receiver 10. Cam pin track 22 includes track surface 34 which is the surface of the body of the receiver in which the cam pin of the bolt and carrier fits within when the receiver in operation. Specifically, cam pin track 22 includes two sidewalls 36. As such, in most prior art variants of AR15/M16 style rifles, sidewalls 36 are about parallel. As used within, top 26 refers to features of receiver 10 in the top most half of the receiver and entirely includes cam pin track 22.

As indicated by numeral 40, high wear area 40 is a located on cam pin track 22. In operation of the firearm with receiver 10, cam pin wear can occur, most often at the area indicated by numeral 40. The edge of the cam pin (not shown) in rotating and moving rearward can rub against the surface of cam pin track 22, particularly at the front of the track next to track relief 38. Over time, this contact can result in a deterioration of the anodizing on the aluminum body of receiver 10, thus causing bare aluminum to be exposed.

In many variants of AR15/M16 style rifles, the upper receiver is primarily formed from aluminum, specifically aluminum alloy 7075. Aluminum alloy 7075 is made with zinc that has comparable strength to a variety of steels though in some compositions has decreased corrosion resistance. In order to increase the durably of these aluminum receivers and improve the upper receiver's resistance to corrosion, often a hard anodized coating is added to the surface. Specifically, Military Specification MIL-A-8625 describes a type of anodic coating for aluminum and aluminum alloys that is often used for upper receivers for AR15/M16 style rifles. This can include a Type III coating wherein the aluminum or aluminum alloy is electrolytically treated to produce a uniform anodic coating on the metal surface which is relatively heavy and dense. The coating thickness is about 0.002 inches for type III which results in improves surface hardness and corrosion resistance. Such coatings may be used with various embodiments of the present invention.

Regardless of this coating being included on prior art AR15/M16 style rifles, the repetition of the cam pin of a bolt and carrier against cam pin track 22 can result in the creation of high wear area 40. This can additionally be exacerbated in piston-operated rifles or when using a suppressor attached to the barrel of an AR15/M16 style rifle.

The friction caused by the cam pin in creating high wear area 40 can erode through the coating on the surface of receiver 10, resulting in a weakness in the receiver. Once the anodized coating is worn through, receiver 10 may erode much more rapidly, resulting in possible failure. Except for high wear area 40, receiver 10 would otherwise be sufficient and have a much longer operating life.

Figure 4:
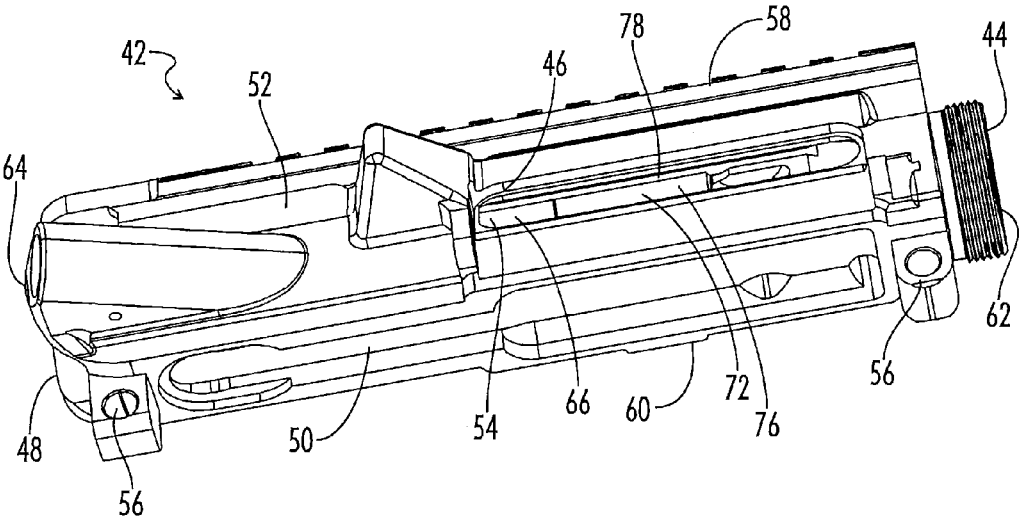
FIG. 4 is an angled-bottom view of an embodiment of the present invention.
Figure 5:
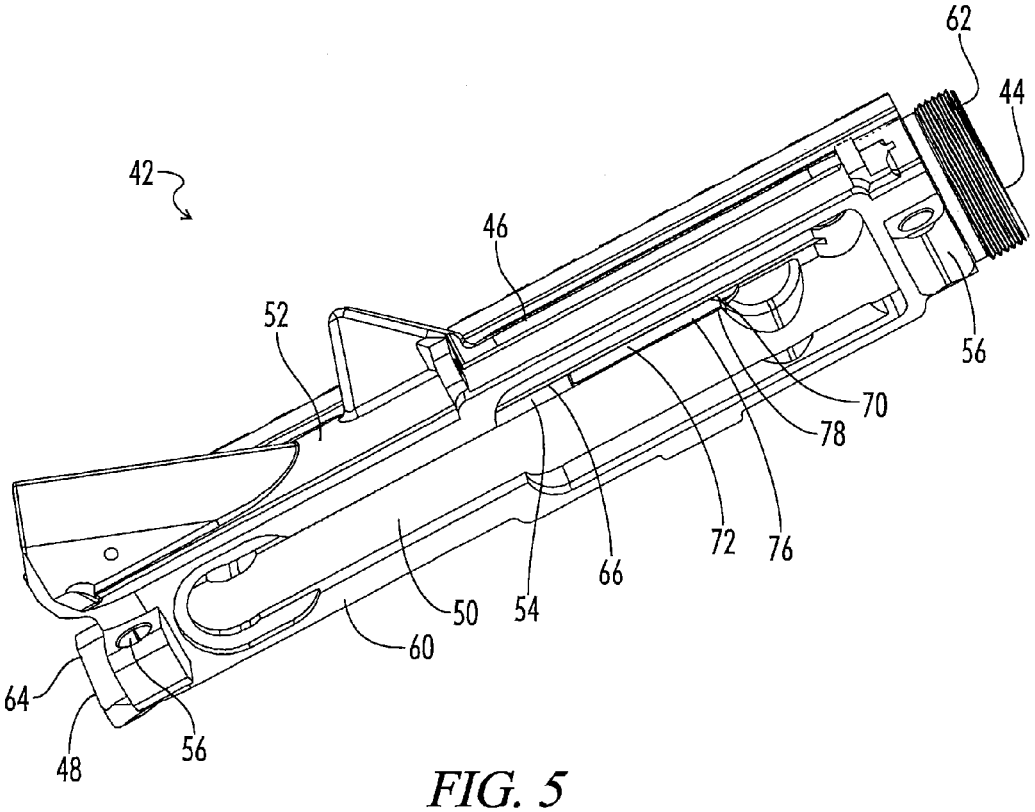
FIG. 5 is a bottom view of an illustration of an embodiment of the present invention.
Figure 6:
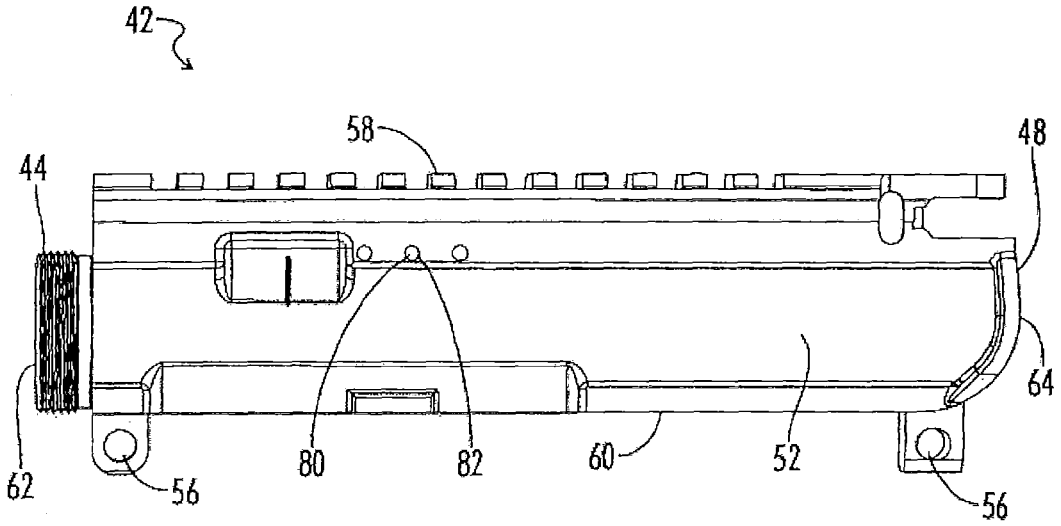
FIG. 6 is a side view of an illustration of an embodiment of the present invention.
Figure 7:
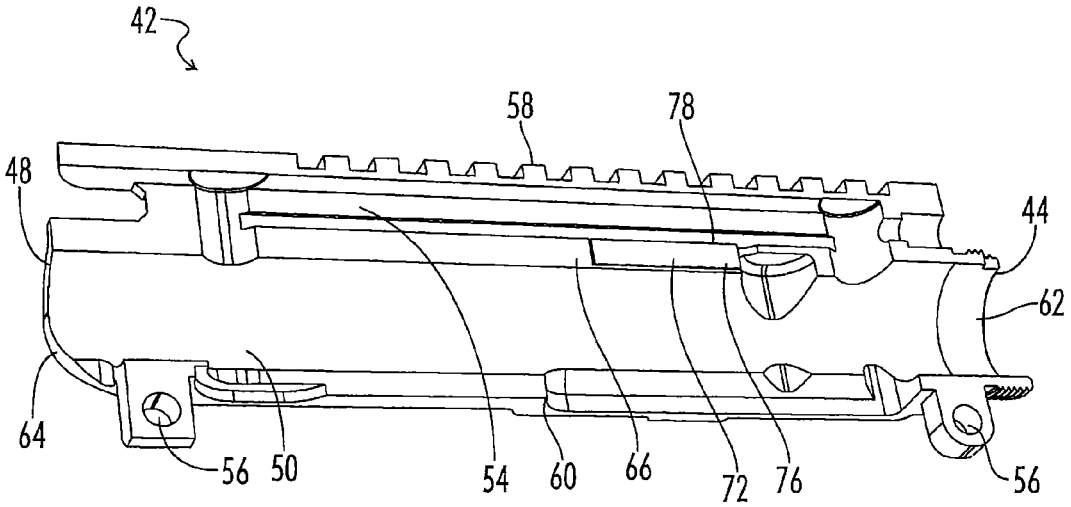
FIG. 7 is a cut-away side view of an illustration of an embodiment of the present invention.
Figure 8:
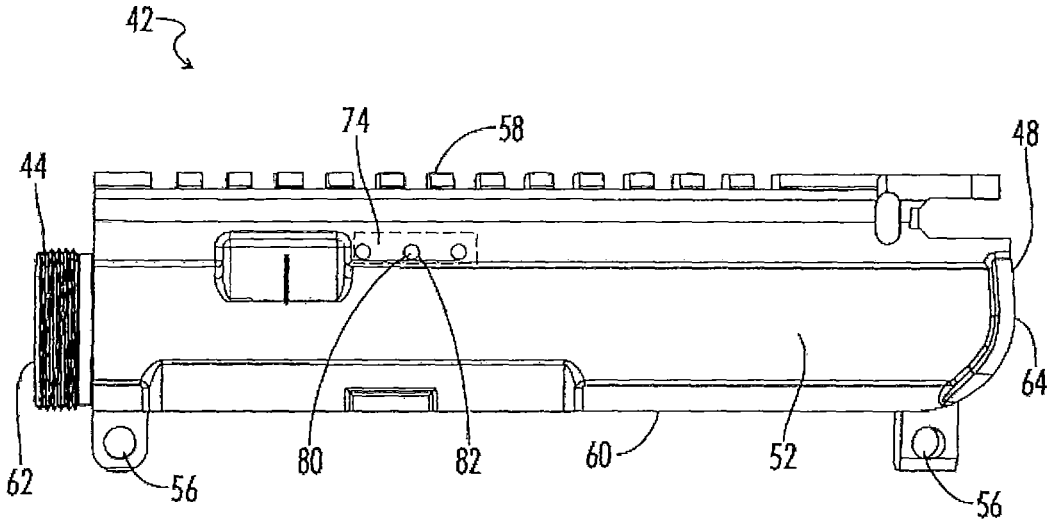
FIG. 8 is a view of an illustration of an embodiment of the present invention showing the rear surface of a wear plate as represented by a dashed-line.

Referring now to FIGS. 4-6 there is an optional embodiment of the receiver of the present invention indicated by numeral 42. Additionally, FIG. 7 provides a cut-away view from front to back of the same optional embodiment of the receiver as illustrated in FIGS. 4-6 and FIG. 8 provides a view of the same embodiment to illustrate the rear surface of the wear plate by a dashed line. Generally, receiver 42 includes barrel extension opening 44, ejection port 46 and rear receiver opening 48. Additionally, receiver 44 also includes interior 50, exterior 52, cam pin track 54, and lower receiver connections 56.

Receiver 42 also has top 58, bottom 60, front 62, and rear 64. Cam pin track 54 may be integrated into the body of receiver 42 and is generally understood to be situated at the top interior surface of receiver 42. Cam pin track 42 includes track surface 66 which is the surface of the body of the receiver in which the cam pin of the bolt and carrier fits within when the receiver in operation. Specifically, cam pin track 54 includes sidewalls 68.

Within cam pin track 54 is wear plate 72 which may optionally form part of one of track surface 66 of cam pin track 54. During operation, wear plate 72 absorbs a portion of the force which otherwise would have been directed toward a location within interior 50 that is similar to high wear area 40 of prior art receiver 10.

Wear plate 72 may be formed from a variety of different materials including metals, allows, ceramics, polymers, coated metals, composites and combinations thereof. In optional embodiments of the invention, wear plate 72 may be steel which can include hardened steel, stainless steel or other steel varieties. Additionally in optional embodiments, wear plate 72 may have a greater resistance to erosion than the anodized aluminum which may form the rest of the body of receiver 42. In optional embodiments, wear plate 72 is permanently affixed within receiver 42. As used herein, "permanently affixed" means that the wear plate is not intended to be removed from the body of the receiver. In further optional embodiments, the wear plate may be replaceable, meaning that the plate is intended to be removable from the receiver. In such embodiments, wear plate 72 may be replaced after being eroded from wear caused by the cam pin moving with the carrier.

In optional embodiments of the invention, a relief cut is formed into the body of receiver 42 with wear plate 72 sized for the relief cut. In such embodiments, wear plate 72, once in place within receiver 42, forms a continuous track surface 66 within cam pin track 54 of receiver 42. Otherwise stated, there may be only a slight to substantially no gap between the edges of wear plate 72 and the edges of track surface 66.

Wear plate 72 may further include rear surface 74 and exposed surface 76. Exposed surface 76 is generally understood to be the surface that will contact the cam pin during operation of the rifle whereas rear surface 74 is the surface that mates against the receiver and is substantially non-visible once in place within the receiver of the present invention. Rear surface 74 may be flat, rounded, or alternatively contoured to fit within relief cut 78. In further optional embodiments, wear plate 72 may be specifically sized to fit within relief cut 78 of receiver 42. As used herein "relief cut" refers to an opening, indentation, recess, or the like for which wear plate 72 may be placed. Generally, relief cut 78 may be coordinated with wear plate 72 so that exposed surface 76 of wear plate 72 is flush with track surface 66 of cam pin track 54 of receiver 42. As viewed in the attached figures, wear plate 72 is within relief cut and only the edge of relief cut 78 is visible next to wear plate 72.

In yet further optional embodiments of the invention, wear plate 72 may include one or more studs 80 to extend into receiver 42 for securing wear plate 72 within relief cut 78 of receiver 42. Studs 80 may be swaged so as to affix wear plate 72 to receiver 42. As used herein, "swaged" or forms thereof, refers to any altering of the dimensions thereof, which may include the use of dies, presses, punches or the like. Thus, swaging may be used upon one or more of studs 80 to attach wear plate 72 within receiver 42. When wear plate 72 includes one or more studs 80, receiver 42 may include stud holes 82 for the placement of studs 80. In such optional embodiments, the studs may then be swaged so as to hold wear plate 72 in place. Any discussion of multiple studs 80 is not intended to be limiting and in further embodiments, either one stud or even no studs may be utilized.

In yet further optional embodiments, wear plate 72 may be attached to receiver 42 in other arrangements. For example, various adhesive bonding agents may be used to attach wear plate 72 and in further embodiments other mechanical fastening arrangements can also be used in addition wear plate 72 to receiver 42. In yet further optional embodiments, welding may be utilized to maintain wear plate 72 in place within relief cut 78 of receiver 42.

Through use of the present invention providing a wear plate at the high wear area of an upper receiver for an AR15/M16 style rifle, a firearm may have an extended usable service life as the wear plate precludes erosion through what would otherwise be an anodized coating and aluminum there beneath. The wear plate of the present invention can reduce this wear by being positioned to absorb the friction and impact caused by the cam pin. By using steel or other optional materials, a user may experience greater service life for such firearm. Furthermore, the wear plate may fit within the receiver of the present invention and provide a continuous surface within the receiver, allowing for use with the many variants AR15/M16 rifle variants.

Furthermore, sizes of various structural parts and materials used to make the above mentioned components are illustrative and exemplary only, and persons of ordinary skill in the art would recognize that these sizes and materials can be changed as necessary to produce different results or different desired characteristics.

It would become apparent to those skilled in the art that various modifications and variations can be made to the structure and methodology of the present invention. Thus, it should be understood that the invention is not limited to the examples discussed in the specification. Rather, the present invention is intended to cover modifications and variations.

The invention claimed is:

1. A upper receiver of a firearm comprising:

a body with a barrel extension opening, ejection port, a rear receiver opening, a top, a bottom, an interior and an exterior, the body having a cam pin track located on the interior top surface of the body of the receiver;

the cam pin track having a track front located near the ejection port, a track rear located closer to the rear receiver opening, a relief cut at the track front and a track surface;

a permanently affixed wear plate on the interior of the body fit within the relief cut of the cam pin track, the wear plate having a rear surface and an exposed surface, the exposed surface forming a continuous track surface flush with the cam pin track in the interior of the body of the receiver.

2. The upper receiver of claim 1 wherein the wear plate further comprises one or more studs extending from the rear surface of the wear plate.

3. The upper receiver of claim 2 further comprising holes in the receiver corresponding to the one or more studs extending from the rear surface of the receiver, each stud extending into each hole with the at least one stud being a swaged stud.

4. An upper receiver of a firearm comprising:

a body with a barrel extension opening, ejection port, a rear receiver opening, a top portion, a bottom portion, an interior and an exterior the body formed of aluminum with an anodized coating;

a cam pin track located on the interior of the body, formed in the receiver at the top portion of the receiver, the cam pin track having a track surface;

the cam pin track having a track front located near the ejection port, a track rear located closer to the rear receiver opening and a relief cut in the track surface; and a permanently affixed wear plate on the interior of the receiver fit within the relief cut of the track surface of the cam pin track, the wear plate having a rear surface and an exposed surface, the exposed surface forming a continuous surface flush with the track surface of the cam pin track, the wear plate having greater resistance to erosion than the body of the receiver.

5. The upper receiver of claim 4 wherein the body is formed of 7075 aluminum and includes an anodized surface.

* * * * *